US005242174A

United States Patent [19]

Koole

[11] Patent Number: 5,242,174

[45] Date of Patent: Sep. 7, 1993

[54] GAME NET POST AND A HORIZONTAL BAR POST AS WELL AS STORING SYSTEMS THEREFOR

[75] Inventor: Peter M. Koole, Kloetinge, Netherlands

[73] Assignee: Schelde International B.V., Netherlands

[21] Appl. No.: 962,980

[22] Filed: Oct. 16, 1992

[51] Int. Cl.[5] ..... A63B 61/04

[52] U.S. Cl. ..... 273/411; 273/29 BB

[58] Field of Search ..... 273/411, 29 BB, 29 B, 273/29 BA, 29 BC

[56] References Cited

U.S. PATENT DOCUMENTS 4,253,671 3/1981 Pace ..... 273/411

4,444,397 4/1984 Kaburagi et al. ..... 273/411

*Primary Examiner*—William H. Grieb

*Attorney, Agent, or Firm*—Ostrolenk, Faber, Gerb & Soffen

[57] ABSTRACT

A game net post, particularly volleyball post and storing system therefor, comprising an outer sleeve adapted to be embedded in substantially and provided with support means and locating means, an inner sleeve provided at the outside thereof with means adapted to be supported by said support means, an outer pipe adapted to be embedded in the ground below said outer sleeve, an inner pipe provided with means allowing it to be suspended from the inner sleeve, a game net post telescopingly arranged within the inner sleeve and at least one negator spring device being attached to the lower end of the game net post and to the inner sleeve.

Preferably two negator spring devices are provided.

A horizontal bar, particularly a high bar post and a storing system therefor have a similar structure as the game net post and storing system.

10 Claims, 6 Drawing Sheets

GAME NET POST AND A HORIZONTAL BAR POST AS WELL AS STORING SYSTEMS THEREFOR

A game net post and a horizontal bar post as well as storing systems therefor.

FIELD OF THE INVENTION

The invention relates to a game net post, and more particularly a volleyball net post, and to a horizontal bar post, as well as a storage system for the post.

STATE OF THE ART

The assignee has manufactured game net posts, and more particularly volleyball net posts and storing systems therefor, wherein the post can be sunk into the ground, covered with a hatch when the game is not being played and the room or field in question has to be used for other sports or other activities. In order to install the game net, two posts can be lifted and set with an appropriate length or height thereof projecting above the ground or floor, for attachment of the net.

In order to balance the weight of the post, and thereby simplify a controlled up and down movement of the post, a counterweight was provided.

In more detail the known post and storing system therefor did comprise an outer sleeve adapted to be embedded in substantially vertical position in the ground with the top thereof substantially at ground or floor level, and being provided with support means and locating means on the internal wall surface thereof, an outer pipe, one end of which is closed and which is adapted to be embedded in substantially vertical position, the closed end down, in the ground below said outer sleeve, an inner pipe, having an external diameter smaller than the internal diameter of the outer pipe provided with means allowing it to be suspended from the inner sleeve in a condition within the outer pipe, a game net post of a substantially circular cross section telescopingly arranged within said inner pipe guiding means on the inner sleeve, the lower end of the inner pipe, in the condition thereof mounted within the outer pipe, being a distance below ground or floor level which is at least substantially equal to the length of the game net post.

This structure presents several disadvantages. In order to accommodate the counterweight within the very limited lateral dimensions of the internal space and yet obtain a sufficient counterbalancing force, lead has to be used, which is expensive and which, nowadays, is considered to be objectionable for reasons of careful use of limited natural resources. The counterweight has to be properly guided within the system during up and down movement of the post. It makes the part of the system which is to be delivered in order to be placed in the part embedded in the ground at the place of use, and which can also be removed therefrom, rather heavy and thereby more difficult to handle. Furthermore during transport, usually in a horizontal position, there is a risk of the wires, serving to support the counterweight, getting entangled. After a long time of use, these wires entail the risk of rupture, with consequent difficulty of recovering the counterweight which will then have fallen on the bottom of the pipe.

OBJECT OF THE INVENTION

In the light of these disadvantages, the main object of the invention is to obviate them all. More particularly it is an object of the invention to provide a game net post and storing system which is simple in manufacturing, light in weight and therefor easy to handle, both during transport and during mounting thereof, and which furthermore allows for a perfect counterbalancing action with a smooth post movement.

An other object of the invention is to provide a similar structure for horizontal bar posts, more particularly posts for the high bar, on the basis of the same structural principles.

SUMMARY OF THE INVENTION

These objects are realized by the invention, basically, by employing at least one negator spring, also called volute spring, with an appropriate structural solution to attach one or two such spring devices to the lower end of the post, within the inner pipe, and with its free end attached to at least one part which will remain immobile with respect to the ground.

Negator or volute springs are known in themselves, but have hitherto not been used for sports equipment. Such a spring device comprises a long strip of spring metal, slightly curved in cross section, and wound upon itself with a diameter as small as possible. The winding is done in the sense which tends to flatten the curved cross section. The result is that, with an appropriate support of the spiralised part and attachment of the free end to a member upon which a force has to be exerted, that such exerted force is constant over a considerable course of displacement of that member, i.e. length of unrollment of the spring strip.

Preferably two such spring devices are employed, with points of attachment substantially diametrically opposed on the post to be counterbalanced. This ensures a very fine smooth movement of the post, which will then be guided by very simple means such as a few nylon rings.

The invention was developed with a particular view on net games such as volleyball. The invention having been made, it turned out to be also applicable to posts for the horizontal bar, and especially for the so called high bar, because the dimensions of negator springs can very easily be chosen such that a long stroke is allowed.

DESCRIPTION OF THE PREFERRED EMBODIMENT

Figure 1:
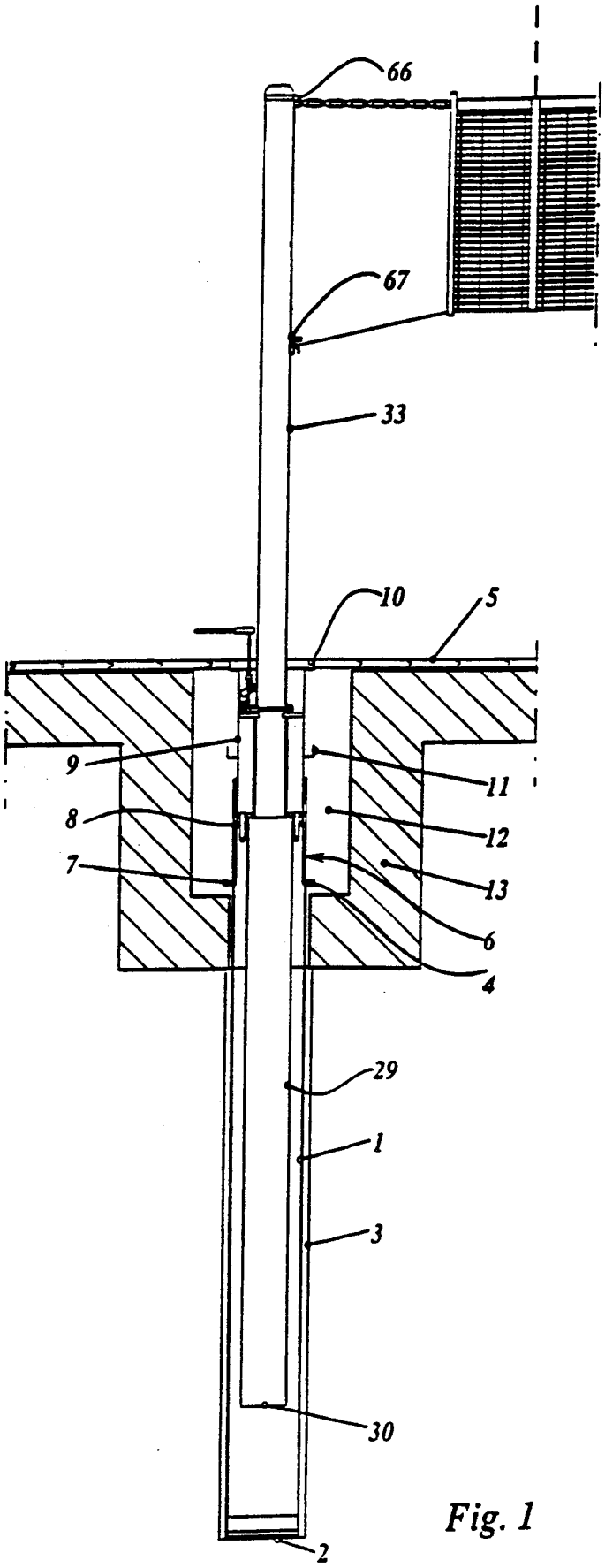
FIG. 1 is a schematic axial sectional view through a volleyball post mounted in its storing system in the preferred embodiment of the invention.

As an example, the drawings represent a volleyball post and storing system therefor; the preferred embodiment is represented and described.

Embedded in the ground, in substantially vertical position, is an outer pipe 1 which may be of circular cross section and may be made in steel or PVC or any other material fit to remain in the ground for an indefinite time period. The bottom end of outer pipe 1 is closed as at 2, the closures being preferably of the same material as pipe 1 with a block of hard wood covering it, employing sealing techniques or sealing material so as to make this closure watertight. Outer pipe 1 may be placed in a borehole 3 when the nature of the soil permits, or otherwise may be placed in a dug hole in case the soil is of a more loose structure, such as of sand.

Pipe 1 is embedded at such a depth that the top thereof will be a certain distance below ground level 5. This distance will be further specified below. Ground level may be the level of a wooden floor, as represented, or may be the level of any other material covering the soil, or may be mineral soil level in case there is no such finishing. On top of pipe 1 is a wooden casing 6 comprising a frame shaped lower portion 7 the inner dimension of which is a little smaller and the outer dimension a little bigger than the inner and outer diameter of pipe 1 so that casing 6 can rest upon top 4 of pipe 1. Casing 6 further comprises, fixed to the angular lower portion 7, a portion 8 on top thereof, this portion having a rectangular cross section.

An outer sleeve 9 preferably in metal, of also rectangular cross section, has outer dimensions substantially corresponding to the inner dimensions of portion 8 of the wooden casing so that the two can slide one within the other. Downward movement of outer sleeve 9 is prevented by a number of nails such as 10 (compare FIG. 2) which are driven through part 8 of wooden casing 6 from the outside and which project inwardly so far as to constitute stops for sleeve 9. The height at which the nails are driven into the wood is used as means for height adjustment of the outer sleeve; depending on small variations of the height in which in fact outer pipe 1 is placed in the soil, outer sleeve 9 can be made to have its top arriving at such a height below ground level 5 as to ensure that the post, in its fully lifted position, will have to height above the ground prescribed by the regulations of the game. This is done so as to leave room, as is known, for a little hatch or cover, not represented, to cover a hole in the floor which makes the post in its storing system accessible.

Outer sleeve 9 is provided externally with a number of preferably hookshape projections such as 11 which are embedded in screed 64 surrounding sleeve 9, which screed again is embedded in a mass of concrete 65 which is poured in reverse hat shape. The top surface of concrete part 65 is at the same height as the soil as far as the space where the post is to be installed doesn't have a full surface concrete floor.

Outer sleeve 9 is provided, on the internal wall surface thereof, with support means 12 and locating means 13 for an inner sleeve 14 which is part of the post assembly which will be inserted into the storing system described so far once this has been properly arranged in the ground. For further details thereof, reference is now made to FIG. 3 to 6.

Figure 3:
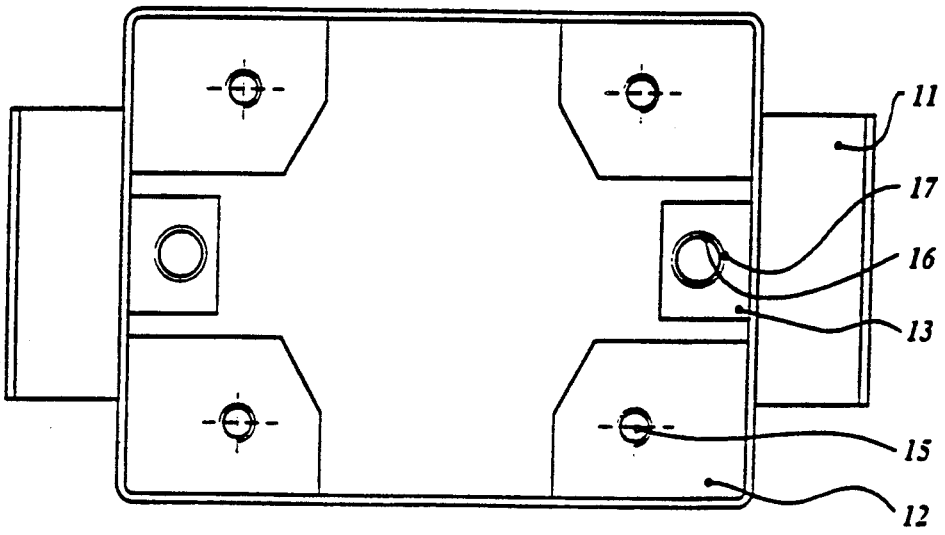
FIG. 3 is a top view of an outer sleeve which is depicted in FIG. 2.

FIG. 3 is a top view of outer sleeve 9 and shows that the support means 12 comprise four plate like members, one in each of the four corners of the rectangular cross section, and each of which is provided with a threaded hole 15. The locating support means 13 comprise two plate like members, one opposite the other in the middle of opposite walls of sleeve 9, and each provided with a thru bore 16 which is chamfered as at 17 at the top. Support means 12 and locating means 13 may all be welded to the inner walls of outer sleeve 9.

FIG. 4 to 7 represent the inner sleeve 14 in more detail.

Figure 4:
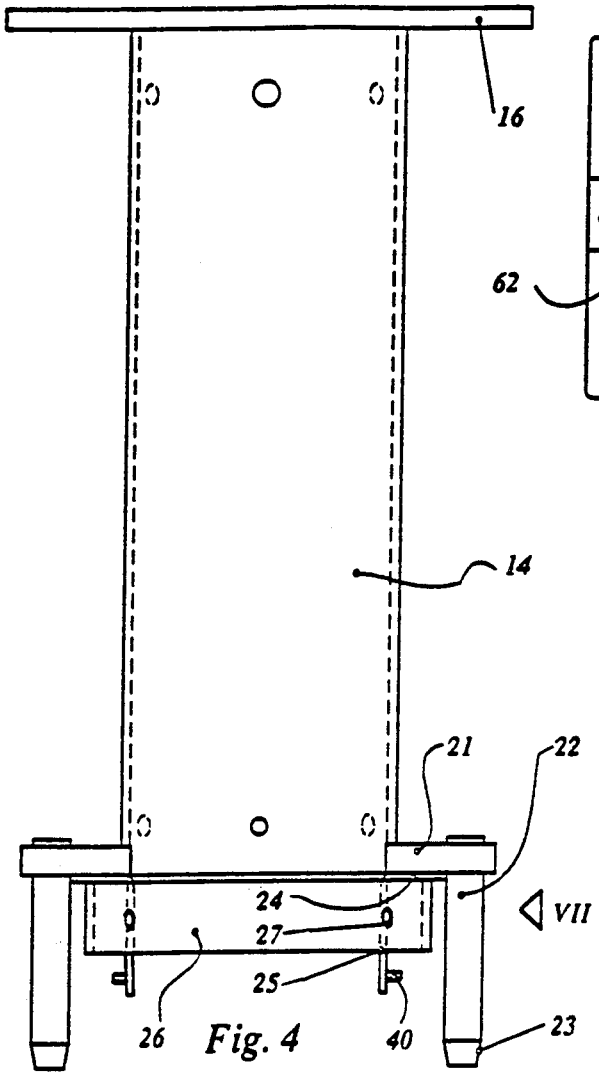
FIGS. 4–7 represent in more detail an inner sleeve depicted also in FIG. 2, FIG. 4 being an elevational view, FIG. 5 a top view, FIG. 6 a bottom view and FIG. 7 a detail according to arrow VII in FIG. 4.
Figure 5:
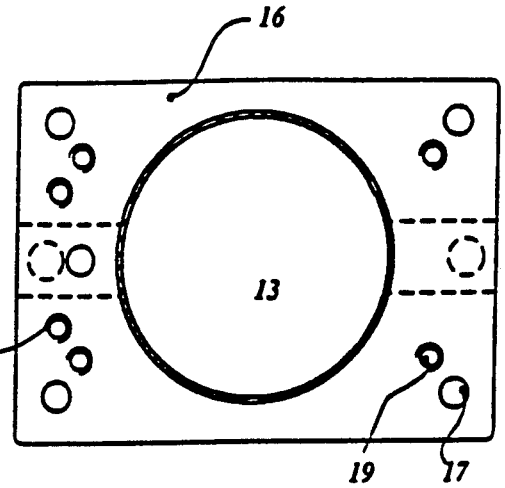
Figure 7:
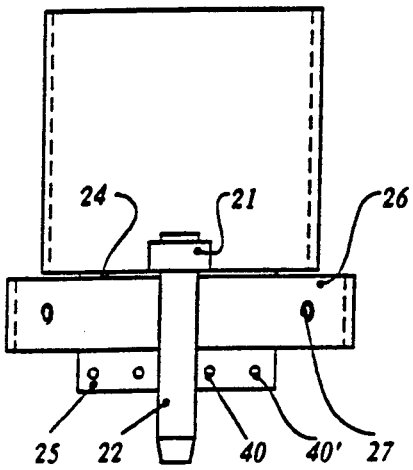
Figure 6:
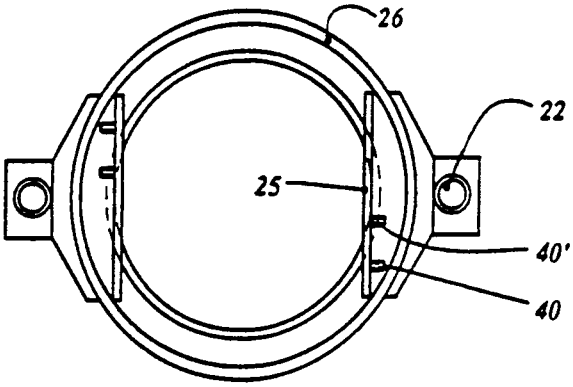

FIG. 4 is a elevational view of the inner sleeve, FIG. 5 a top view, FIG. 6 a bottom view and FIG. 7 a partial side elevational view according to arrow VII in FIG. 4.

Figure 2:
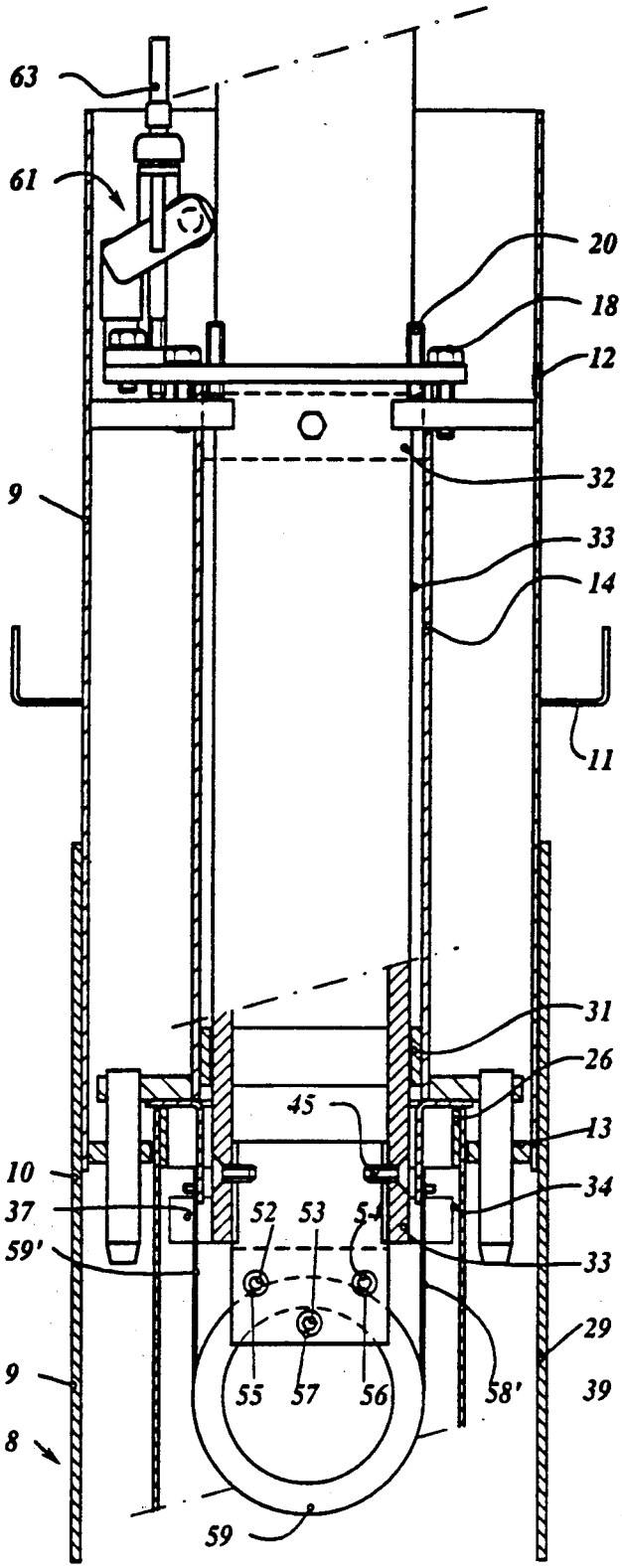
FIG. 2 is a partial axial sectional view of the storing system and post represented in FIG. 1, which illustrates further details.

Inner sleeve 14 is a cylindrical tube with circular cross section, provided at its upper end with a rectangular plate 16. Plate 16 has four holes such as 17 close to each of the corners, of a diameter sufficient to allow the introduction of bolts such as 18 (FIG. 2) which, after assembling, will engage threaded holes 15 (FIG. 3) in upper support plates 12. Plate 16 also has threaded holes 19 adapted to engage threaded adjustment pins 20 (FIG. 2).

The lower end of inner sleeve 14 has welded to the outer surface thereof, at two opposite locations, two lugs 21, substantially of rectangular shape except for the side welded to the round sleeve. Inserted in a hole of lugs 21 and welded thereto are two pins such as 22, chamfered at their lower ends as at 23. These chamfered ends serve as locating means when, in the mounting process, these pins are inserted into chamfered boreholes 16 in lower support plates 12 (compare FIG. 2 and 3).

Welded in turn to the bottom of each of the lugs are two angular brackets. Each such bracket comprises a horizontal flange portion 24 used for welding the bracking to the lug, and a downwardly extending flange portion 25. On one side of the axial plane perpendicular to flange 25, each flange 25 carries two threaded ends 40, 40' of relatively short length. Welded again to the lower surface of horizontal flange portion 24 of each bracket is a short piece of cylindrical tube 26 or ring, provided with a number of screwholes such as 27, in this instance there being four such holes.

The outer diameter of ring 26 corresponds with the inner diameter of a pipe 29, and that pipe 29 can be suspended from ring 26, and thereby from the inner sleeve 14, by a number of screws such as 28 (FIG. 2A) which are inserted through appropriated holes in pipe 29 and are engaged in threaded holes 27 in ring 26.

Reverting now to FIG. 1 it will be apparent that pipe 29, which will henceforth be termed inner pipe, extends, in the mounted condition, over a considerable length down into outer pipe 1. In fact it may nearly reach the bottom 2 of outer pipe 1 provided that variations in the mounting height of outer pipe 2 with respect of ground-level 5 are accounted for. The bottom of inner pipe 29, preferably in PVC material, may be closed in a watertight manner, such as by welding or glueing a cap, as an additional security against penetration of water in case of imperfect tightness of the bottom 2 of outer pipe 1.

Figure 8:
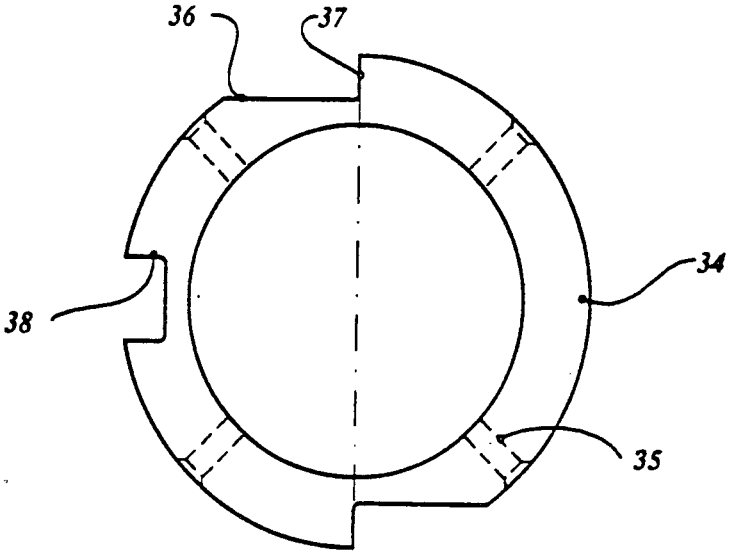
FIG. 8 is a top view of a ring represented in FIG. 2 and 2A.

As appears from FIG. 2 one ring 31, preferably made of nylon or other low friction material, is glued or otherwise permanently attached inside inner sleeve 13 near the bottomend thereof, and a similar ring 32 near the top thereof. Rings 31 en 32 serve as guiding means for net post 33. Both FIG. 1 and 2 represent game post 33 in its highest position, ready for use. As is particularly visible in FIG. 2 and 2A, the lower end 33' of game post 33 is provided with an external ring 34, which is represented in top view in FIG. 8. It is attached to lower post end 33' by means of screws, not represented, inserted through threaded holes such as 35. Ring 34 is preferably also made of nylon or any other low friction material because it will serve to guide the lower end of post 33 when it is being pushed down into inner pipe 29 into its storage position. For this purpose the outer diameter of ring 34 is just so much smaller than the inner diameter of inner pipe 29 as will be necessary for a smooth, guided telescoping movement.

Figure 9:
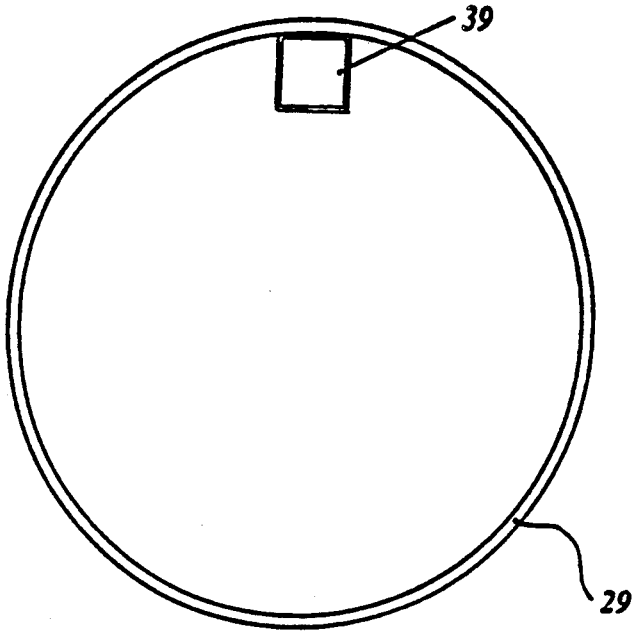
FIG. 9 shows the cross sectional profile of an inner pipe.
Figure 11:
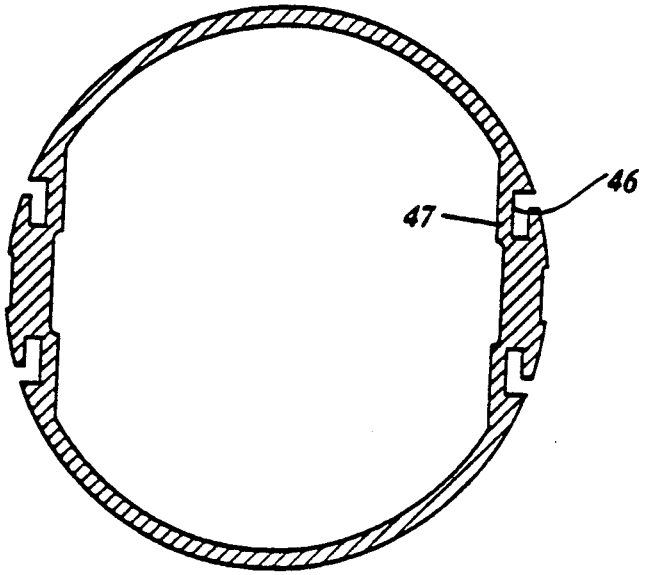
FIG. 11 shows the cross sectional profile, known in itself, of a game net post.

Ring 34 is provided at two opposite places with cutouts, such as 36, the cutout being made in short lengths along a diagonal plane as indicated at 37, and a part 36 perpendicular thereto. The cutouts serve to accommodate the fixation of negator springs, to be described below. Ring 34 is also provided with a cutout 38 of substantially rectangular shape. This is an accommodation for a substantially square profile 39, just visible near the lower end of FIG. 2 and in FIG. 2A, but most clearly in the cross sectional view of FIG. 9. This profile is attached to the inner wall of part 29, by welding or screwing through pipe 29, and the cooperation thereof with the cutout 38 will prevent any rotation of the post 33 during its up and down movement.

Figure 10A:
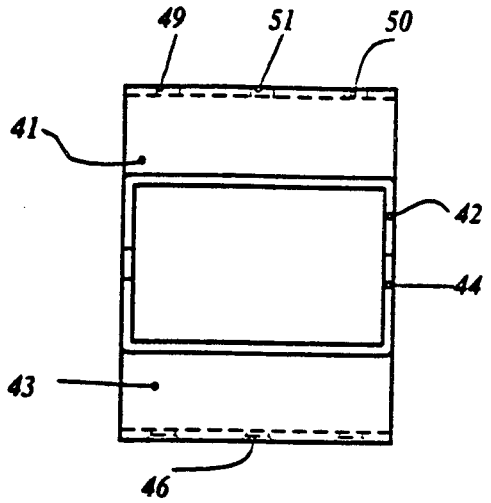
FIG. 10A-10C represent a connecting piece, FIG. 10A being a top view, FIG. 10B an elevational view in one direction and FIG. 10C an elevational view from the orthogonal direction.
Figure 10B:
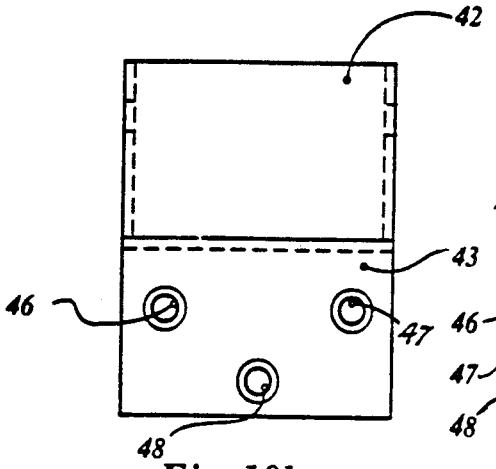
Figure 10C:
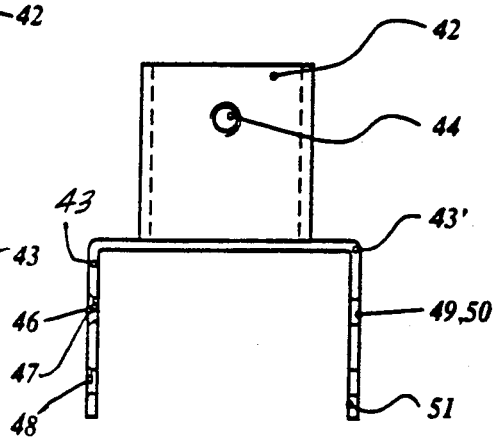

Reverting to the fixation of the negator springs: FIG. 10A, 10B and 10C show from orthogonal directions the special connecting piece, indicated as a whole by 41. It is constructed of a piece of rectangular tube 42 to which an inverted U-shaped bracket 43 has been welded. Two opposite walls of tube 42 are provided with threaded holes 44 by which this piece, after the tube shaped part 42 thereof having been inserted into the lower end of post 33, can be fixed thereto by means of screws such as 45 (FIG. 2) introduced thru appropriate holes in the material of post 33. It is pointed out that it is common to use game posts having the cross sectional profile represented in FIG. 1. Slits 46, in a manner also known long since, serve as slideways for the hooks to which the game net is attached. In that connection the post profile, being substantially circular in outer circumference, has an inner circumference presenting substantially flat areas such as 47. Against these, the rectangular tube part 42 of connection piece 41 will come to rest.

After fixation of the connecting piece 41, flanges 43 of the U-shape bracket will project downwardly from the post. Flange 43 is provided with three thru holes 46, 47, 48 at the places visible in FIG. 10C, and which may be widened in order to accommodate flat headed screws. The other flange 43', at corresponding locations three threaded holes 49, 50, 51, respectively, so as to accommodate long screws 52, 53, 54, respectively, extending from one flange 43 of bracket 41 to the other flange 43', surrounded by tubes 55, 56, 57, respectively, of appropriate diameter, such as 52 (FIG. 2A).

Figure 2A:
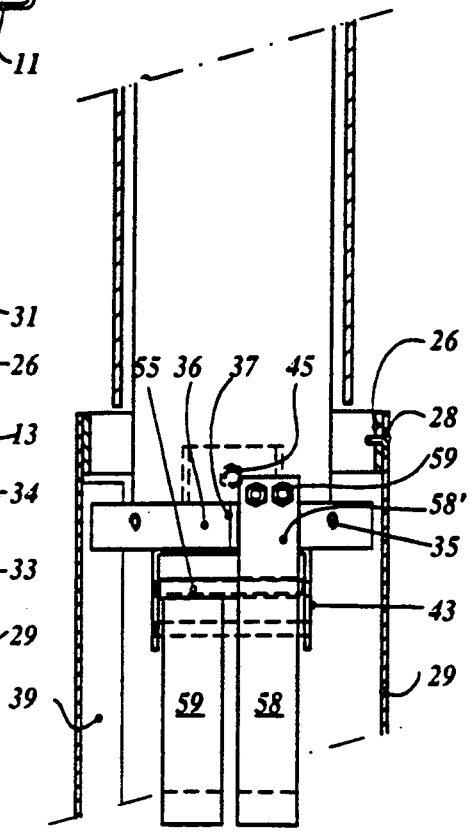
FIG. 2A is again a part of what is represented in FIG. 2, as an axial sectional view perpendicular to the view of FIG. 2, but more of the inner parts being represented in elevation rather than in cross sectional view.

There are two negator springs, indicated as a whole by 58 and 59 respectively (FIG. 2A). One spring 58 has its upper end 58' attached by means of holes which are placed over the short threaded ends 40, 40' carried (FIG. 4, 6 and 7) by lower flange 25 of one bracket suspended from the inner sleeve. Fixation of spring end 58' is completed by a pair of nuts such as 60. Negator spring 58 is spiralised in itself in the manner known for this type of springs, and it is kept in place with respect to connecting piece 41 and therefor with respect to the lower end of game post 33, by the spiral thereof being guided between tubes 55 and 56 outside the spiral and tube 57 inside the spiral. The same is true for the spiral of spring 59 but the upper end 59' thereof is attached at the opposite side, in the same manner as described already, with respect to the other pair of threaded ends opposite the ends 40, 40' used for spring 58. The effect of two negator springs being used, and the springs being attached at opposite locations at the lower end of the game post, is that they ensure a smooth up and down movement of the post without substantial lateral forces.

In order to complete the description the reader is again referred to FIG. 2. Affixed to top plate 16 of inner sleeve 13 is a lock mechanism indicated as a whole by 61. This is a structural part which belongs to the state of the art already and therefore needs not to be described in detail. It is affixed to top plate 16 by a number of threaded holes such as 62 (FIG. 5) and it is operated by a removable handle 63 so as to clamp post 33 in any vertical position which it assumes at the moment when locking device 61 is operated.

The mounting and operation are as follows. Outer pipe 1 is placed in the ground. Wooden casing 6 is placed on top of it and outer casing 11 is adjusted in the prescribed height by driving in the nails 10 at the appropriate height. The top of the system is embedded in the mass of concrete 65 and screed 64. This is the embedded part which will remain in the ground for an indefinite period of time.

All other parts are mounted in the manner described and shown as a removable part; most important members of this removable part are inner sleeve 14 provided with its adjustment means 20 and pins 22 cooperating with locating means 14, and the post proper, connected to the other parts by means of the negator springs 58, 59.

After inserting this removable part into the embedded part, with the pins 22 entering the holes in locating means 13, adjusting the proper height by means of the adjustment pins 20 and fixing this height by means of bolts 18, the post is mounted in its storing system and is ready for use. In the unlocked condition of locking means 61 it can be grabbed by its top, pushed down into the storing system and pulled upwards into the position in which it is ready to be used in the game, such as depicted in FIG. 1, in which position it will be locked. When letting post 33 sink into its storing system, hooks 66, 67, serving to attach the game net, will of themselves shift in slits 46 in the post, and they will come to rest on top plate 16 of inner sleeve 14 which they are unable to pass. There is ample space for them within outer sleeve 9, in the upper portion thereof.

What is claimed is:

1. A game net post and storing system therefor, comprising an outer sleeve (9) adapted to be embedded in substantially vertical position in the ground with the top (10) thereof substantially at ground or floor level (5), and being provided with support means (12) and locating means (13) on the internal wall surface thereof, an inner sleeve (14) having lateral external dimensions smaller than the smallest internal dimension of the outer sleeve (9), provided at the outside thereof with means (16–18) adapted to be supported by said support means (12), and provided on its internal wall surface with guiding means (31, 32), an outer pipe (1), one end of which is closed (2) and which is adapted to be embedded in substantially vertical position, the closed end down, in the ground below said outer sleeve, an inner pipe (29), having an external diameter smaller than the internal diameter of the outer pipe provided with means (21, 23–26) allowing it to be suspended from the inner sleeve (13) in a condition within the outer pipe, a game net post (33) of a substantially circular cross section telescopingly arranged within said guiding means on the inner sleeve, the lower end of the inner pipe, in the condition thereof mounted within the outer pipe, being a distance below ground or floor level (5) which is at least substantially equal to the length of the game net post (33), at least one negator spring device (58) being attached to the lower end of the game net post (33) and to the inner sleeve (14).

2. A game net post and storing system therefor as in claim 1, wherein an angular bracket (24, 25) is attached to the lower end of the inner sleeve (14), said bracket having a flange (25) directed downwardly, in mounted condition, provided with means (40, 40') for attachment of the free end (58') of the negator spring 58.

3. A game net post and storing system therefor as in claim 1, wherein a connecting piece (41) is attached to the lower end of the game net post (33), said bracket having a reverse U-shaped bracket (43) the flanges of which are, in mounted condition, directed down from the post, serving as means to carry, in the space between the flanges, bolt means (55, 56, 57) at such locations as to maintain in place the spiralised negator spring (58).

4. A game net post and storing system therefor as in claim 1, wherein two negator spring devices (58, 59) are provided, there being one angular bracket (24, 25) for attachment of the free end (58', 59') of each such spring device to the lower end of the inner sleeve, said brackets being located at diametrically opposed placed with respect to the inner sleeve, and wherein a connecting piece (41) is attached to the lower end of the game net post (33), said bracket having a reverse U-shaped bracket (43) the flanges of which are, in mounted condition, directed down from the post, serving as means to carry, in the space between the flanges, bolt means (55, 56, 57) at such locations as to maintain in place the two spiralised negator springs (58).

5. A game net post and storing system therefor, comprising

A) a part to be embedded in the ground, which comprises an outer sleeve (9) adapted to be embedded in substantially vertical position with the top thereof substantially at ground or floor level (5), and being provided with support means (11) and locating means (13) on the internal wall surface thereof, an outer pipe (1), one end of which is closed (2) and which is adapted to be embedded in substantially vertical position, the closed end down, below said outer sleeve, a casing (6) having a wall portion (8) and frame-like lower portion (7) having dimensions such that it can be embedded resting on top (4) of said outer pipe, the wall portion of the casing and the outer sleeve being dimensioned such that they can be slidably arranged one inside the other, and means (10) being provided to carry the outer sleeve in an adjusted vertical position with respect to the outer pipe, and B) a part to be removably placed in the part to be embedded in the ground, and which comprises, an inner sleeve (14) having lateral external dimensions smaller than the smallest internal dimension of the outer sleeve (9), provided at the outside thereof with means (16–18) adapted to be supported by said support means (12), and provided on its internal wall surface with guiding means (31, 32), an inner pipe (29), having an external diameter smaller than the internal diameter of the outer pipe provided with means (21, 23–26) allowing it to be suspended from the inner sleeve (14) in a condition within the outer pipe, a game net post (33) of a substantially circular cross section telescopingly arranged within said guiding means on the inner sleeve, the lower end of the inner pipe, in the condition thereof mounted within the outer pipe, being a distance below ground or floor level (5) which is at least substantially equal to the length of the game net post (33), at least one negator spring device (58) being attached to the lower end of the game net post (33) and to the inner, sleeve (13).

6. A game net post and storing system therefor as in claim 5, wherein two negator spring devices (58, 59) are provided, there being one angular bracket (24, 25) for attachment of the free end (58', 59') of each such spring device to the lower end of the inner sleeve, said brackets being located at diametrically opposed placed with respect to the inner sleeve, and wherein a connecting piece (41) is attached to the lower end of the game net post (33), said connecting piece having a reverse U-shaped bracket (43) the flanges of which are, in mounted condition, directed down from the post, serving as means to carry, in the space between the flanges, bolt means (55, 56, 57) at such locations as to maintain in place the two spiralised negator springs (58).

7. A volleyball net post and storing system therefor, comprising an outer sleeve (9) adapted to be embedded in substantially vertical position in the ground with the top thereof substantially at ground or floor level (5), and being provided with support means (12) and locating means (13) on the internal wall surface thereof, an inner sleeve (14) having lateral external dimensions smaller than the smallest internal dimension of the outer sleeve (9), provided at the outside thereof with means (16–18) adapted to be supported by said support means (12), and provided on its internal wall surface with guiding means (31, 32), an outer pipe (1), one end of which is closed (2) and which is adapted to be embedded in substantially vertical position, the closed end down, in the ground below said outer sleeve, an inner pipe (29), having an external diameter smaller than the internal diameter of the outer pipe provided with means (21, 23–26) allowing it tot be suspended from the inner sleeve (14) in a condition within the outer pipe, a volleyball net post (33) of a substantially circular cross section telescopingly arranged within said guiding means on the inner sleeve, the lower end of the inner pipe, in the condition thereof mounted within the outer pipe, being a distance below ground or floor level (5) which is at least substantially equal to the length of the volleyball net post (33), at least one negator spring device (58) being attached to the lower end of the volleyball net post (33) and to the inner sleeve (13).

8. A volleyball net post and storing system as in claim 7, wherein two negator spring devices (58, 59) are provided, there being one angular bracket (24, 25) for attachment of the free end (58', 59') of each such spring device to the lower end of the inner sleeve, each such angular bracket (24, 25) being attached to the lower end of the inner sleeve and having a flange (25) directed downwardly, in mounted condition provided with means (40, 40') for attachment of the free end of a negator spring, and said brackets being located at diametrically opposed places with respect to the inner sleeve, and wherein a connecting piece (41) is attached to the lower end of the game net post (33), said connecting piece having a reverse U-shaped bracket (43) the flanges of which are, in mounted condition, directed down from the post, serving as means to carry, in the space between the flanges, bolt means (55, 56, 57) at such locations as to maintain in place the two spiralised negator springs (58).

9. A horizontal bar post and storing system therefor, comprising an outer sleeve (9) adapted to be embedded in substantially vertical position in the ground with the top thereof substantially at ground or floor level (5), and being provided with support means (12) and locating means (12) on the internal wall surface thereof, an inner sleeve (14) having lateral external dimensions smaller than the smallest internal dimension of the outer sleeve (9), provided at the outside thereof with means (16–18) adapted to be supported by said support means (12), and provided on its internal wall surface with guiding means (31, 32), an outer pipe (1), one end of which is closed (2) and which is adapted to be embedded in substantially vertical position, the closed end down, in the ground below said outer sleeve, an inner pipe (29), having an external diameter smaller than the internal diameter of the outer pipe provided with means (21, 23–26) allowing it tot be suspended from the inner sleeve (14) in a condition within the outer pipe, a horizontal bar post (33) of a substantially circular cross section telescopingly arranged within said guiding means on the inner sleeve, the lower end of the inner pipe, in the condition thereof mounted within the outer pipe, being a distance below ground or floor level (5) which is at least substantially equal to the length of the horizontal bar post (33), at least one negator spring device (58) being attached to the lower end of the horizontal bar post (33) and to the inner sleeve (14).

10. A horizontal bar post and storing system therefor as in claim 9, wherein an outer sleeve (9) adapted to be embedded in substantially vertical position in the ground with the top thereof substantially at ground or floor level (5), and being provided with support means (12) and locating means (13) on the internal wall surface thereof, an inner sleeve (14) having lateral external dimensions smaller than the smallest internal dimension of the outer sleeve (9), provided at the outside thereof with means (16–18) adapted to be supported by said support means (12), and provided on its internal wall surface with guiding means (31, 32), an outer pipe (1), one end of which is closed (2) and which is adapted to be embedded in substantially vertical position, the closed end down, in the ground below said outer sleeve, an inner pipe (29), having an external diameter smaller than the internal diameter of the outer pipe provided with means (21, 23–26) allowing it tot be suspended from the inner sleeve (14) in a condition within the outer pipe, a horizontal bar post (33) of a substantially circular cross section telescopingly arranged within said guiding means on the inner sleeve, the lower end of the inner pipe, in the condition thereof mounted within the outer pipe, being a distance below ground or floor level (5) which is at least substantially equal to the length of the horizontal bar post (33), at least one negator spring device (58) being attached to the lower end of the horizontal bar post (33) and to the inner sleeve (14).

* * * * *